United States Patent [19]

Riggs et al.

[11] Patent Number: 4,534,162

[45] Date of Patent: Aug. 13, 1985

[54] PLASTIC ENCAPSULATED WIRE ROPE

[75] Inventors: Peter P. Riggs, Isle of Man, Isle of Man; Harry L. Data; Robert B. Hoganson, Jr., both of Kenosha, Wis.

[73] Assignee: AMSTED Industries Incorporated, Chicago, Ill.

[21] Appl. No.: 521,068

[22] Filed: Aug. 8, 1983

[51] Int. Cl.[3] ..... D07B 1/16; D07B 7/12

[52] U.S. Cl. ..... 57/217; 57/7; 57/223

[58] Field of Search ..... 57/7, 210, 213, 217, 57/218, 221, 223, 241, 258

[56] References Cited

U.S. PATENT DOCUMENTS

| | | | |
|---|---|---|---|
| 3,015,205 | 1/1962 | Massot et al. | 57/217 |
| 3,154,910 | 11/1964 | Dietz | 57/217 X |
| 3,391,531 | 7/1968 | Riggs et al. | 57/217 |
| 4,158,946 | 6/1979 | Bourgois | 57/213 |
| 4,197,695 | 4/1980 | Hughes et al. | 57/7 |
| 4,202,164 | 5/1980 | Simpson et al. | 57/7 X |
| 4,422,286 | 12/1983 | Simpson et al. | 57/7 X |

*Primary Examiner*—Donald Watkins

*Attorney, Agent, or Firm*—Charles E. Bouton; Edward J. Brosius

[57] ABSTRACT

A wire rope is provided having a central core strand about which are wound outer strands. Spacer strands are present in the gaps between such core strand and outer strands to assume the uniformity of such gaps. A coating, usually of a suitable thermoplastic, is extruded into such rope to provide a spacer between such core and such outer strands, and between adjacent outer strands.

20 Claims, 7 Drawing Figures

PLASTIC ENCAPSULATED WIRE ROPE

BACKGROUND OF THE INVENTION

The present invention relates to wire rope and, more particularly, to plastic encapsulated wire rope having spacer strands between its central core strand and surrounding outer strands.

Plastic encapsulated wire rope, such as disclosed in U.S. Pat. No. 3,824,777, has been demonstrated to have properties such as tensile strength, fatigue life and corrosion resistance superior to those of equal size bare wire rope. Such improved properties are derived from the separation of the core strand from the outer strands and the outer strands from each other by the thermoplastic material. Suitable themoplastics include polypropylene, polyurethane, polyethylene, nylon, tetrafluroethylene or polyvinylchloride. Also useful are elastomers such as butyl or nitrile rubber. Such a coating reduces or eliminates such core to strand and strand to strand contact and abrasion when the rope is in service. Further, the coating traps any desired lubricant such as petrolatum within the strands and resists the ingress of abrasive or corrosive elements into the rope.

However, it is desirable to achieve strand gap or interstice balance in the manufacture of such plastic encapsulated wire rope. Such gap balance insures the equal load sharing by the strands of the rope and also assures the spacing between strands is filled with plastic. One method of such gap control during rope manufacture is set forth in U.S. Pat. No. 3,824,777, wherein a strand gap controller die is utilized to equally separate rope strands during the injection of the plastic.

Another spacing control method is disclosed in U.K. patent application No. 2,090,305 A, wherein a filler element of thermoplastic containing a reinforcing core is placed independently in the interstice. The presence of such independent thermoplastic element would prohibit the introduction of a flowable thermoplastic into the wire rope.

It is an object of the present invention to provide an encapsulated wire rope having uniform strand gaps and a method of making such rope.

SUMMARY OF THE INVENTION

The present invention relates to a wire rope having uniform strand separation and interstices and to a method of making such rope.

The rope is comprised of a central core usually comprising strands forming an independent wire rope core (IWRC). Such rope core is surrounded by a plurality of outer strands, each comprised of a plurality of individual wires. As such outer strands are wound around the core, there are gaps or spaces or interstices between such outer strands and the core. As the diameters of the core strand and the outer strands are normally within 25% of each other, those gaps are small. However, it is important for the wear life and other similar properties of the rope that such gaps are as uniform as possible. This insures that during the extrusion of the coating material within the rope that such coating provides a uniform spacing between the core strand and the outer strands and between adjacent outer strands. Accordingly, a spacer strand is placed in each such gap during the closing or rope forming operation. Such spacer strand can take different forms as will be later explained, but the main function of such spacer strand is to insure the uniform gap formation between the outer strands. Further, the spacer strand must be of such a configuration so as to permit the impregnation of the rope after final closing by a coating material such as a themoplastic or an elastomer in an extrusion operation.

To permit the coating to be extruded into the spaces between the core strand and the outer strand, the spacer strands must provide gaps or some other type of passage for the coating material. To insure the uniformity of the spaces between the outer strands, each spacer strand contacts both the core strand and two outer strands. Another way of viewing the preferred arrangement is that each outer strand contacts two spacer strands to assure the positioning and spacing of the outer strand. The spacer strands may take any one of several configurations. A single wire may be wound into a helix arrangement to provide the necessary spacing and coating flow configuration. A single central wire can be surrounded by either one or two helixed wires to again provide the necessary spacing and coating flow configuration. Further, two or three wires may be helically wound to form a rope structure which will provide the necessary spacing and coating flow configuration.

In particular, the present invention provides a wire rope comprising a central core including a plurality of wire strands, a plurality of outer strands surrounding said core, a plurality of spacer strands located in the interstices between said core and said outer strands, and a coating extending from substantially the outer diameter of the outer stands down to and into the central core.

The present invention also provides a method of manufacturing a wire rope comprising the steps of providing a central core strand, winding a plurality of spacer strands about said core strand, winding a plurality of outer strands about said spacer strands and said core strand so as to form evenly dimensioned interstices between said core stand and said outer strands containing said spacer strands, and injecting a coating into said wire rope so as to form a continuous, single element composition between the central core and the outer strands.

With a rope according to the invention it is possible to maintain a series of strand to strand gaps of even dimension which permits the ingress of plastic between the strands through the passageways in the spacer element into the core. The equal strand gaps permit a continuous coating of plastic to be formed to provide a positive bond for the external infilling to the underlaying infilling, thereby preventing the detachment of the external infilling under arduous operating conditions during the periods of continual flexing around smaller than desirable sheaves or drums.

DESCRIPTION OF THE PREFERRED EMBODIMENT

Figure 1:
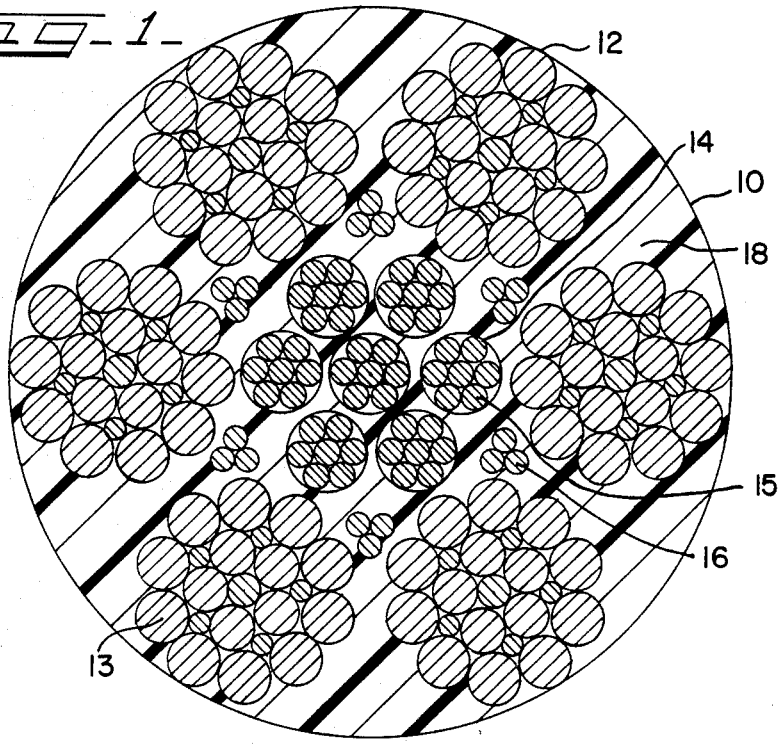
FIG. 1 is a cross sectional view of an encapsulated wire rope made in accordance with the present invention.

Referring now to FIG. 1 of the drawings, a wire rope is shown generally at 10. A central core strand 14 comprises several single wires 15 in a wire rope configuration. Core 14 is surrounded by a plurality of outer strands 12, each of which is comprised of several single wires 13 in a wire rope configuration. Spacer strands 16 are present in the interstices between core 14 and outer strands 12. Spacer strands 16 are shown as comprising three wires wound to form a strand. A coating 18 extends from the outer surface of core 14 to the outer diameter limits of outer strands 12. Each spacer strand 16 contacts core 14 and two outer strands 12. Coating 18 usually comprises a thermoplastic, and separate core strand 14 from outer strands 12, as well as outer strands 12 from adjacent outer strands. Coating 18 is uniform and, due to its extruded introduction into rope 10, forms a continuous single element composition.

Figure 2:
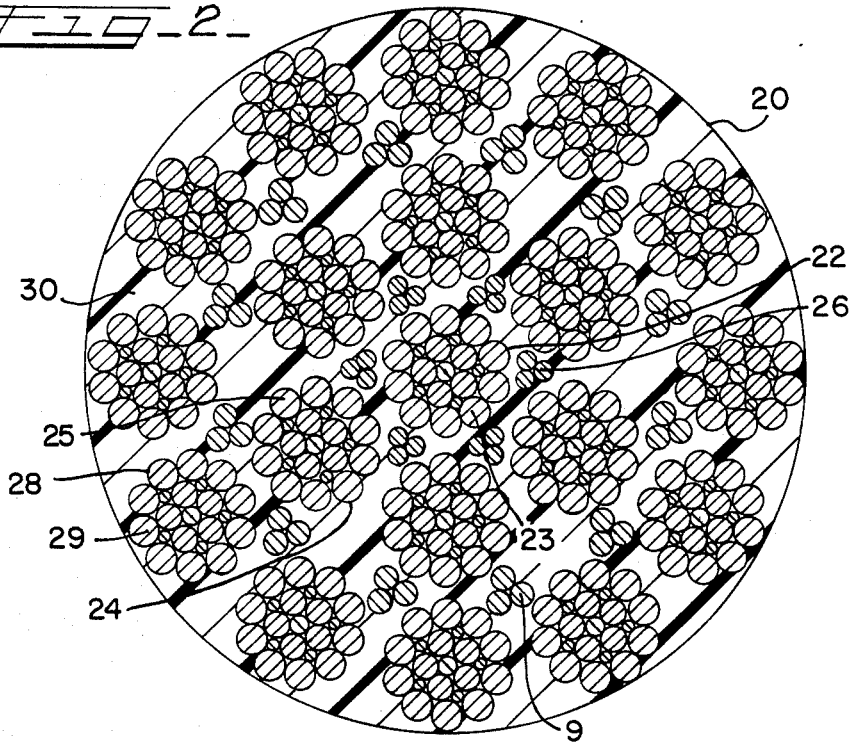
FIG. 2 is a cross sectional view of another encapsulated wire rope made in accordance with the present invention.

Referring now to FIG. 2 of the drawings, a wire rope is shown generally at 20. A central core strand 22 is provided and is comprised of a plurality of individual wires 23 in a wire rope configuration. Surrounding core strand 22 are a plurality of intermediate strands 24, each of which is comprised of a plurality of individual wires 25. Spacer strands 26 are located in the interstices between core strand 22 and intermediate strands 24, and spacer strands 9 are located in the interstices between intermediate strands 24 and outer strands 28. Spacer strands 26 and 9 are shown as comprising three wires wound to form a strand. A plurality of outer strands 28 surround intermediate strands 24. Each outer strand 28 is comprised of a plurality of individual wires 29. A coating 30 extends from the outer surface of core 22 to the outer diameter limits of outer strands 28. Each spacer strand 26 contacts core 22 and two intermediate strands 24, and each spacer strand 9 contacts an intermediate strand 24 and an outer strand 28. Coating 30 usually comprises a thermoplastic, and separates core strand 22 from intermediate strands 24, intermediate strands 24 from outer strands 28, intermediate strands 24 from adjacent intermediate strands and outer strands 28 from adjacent outer strands. Coating 30 is uniform and, due to its extruded introduction into rope 20, forms a continuous, single element composition.

Figure 3:
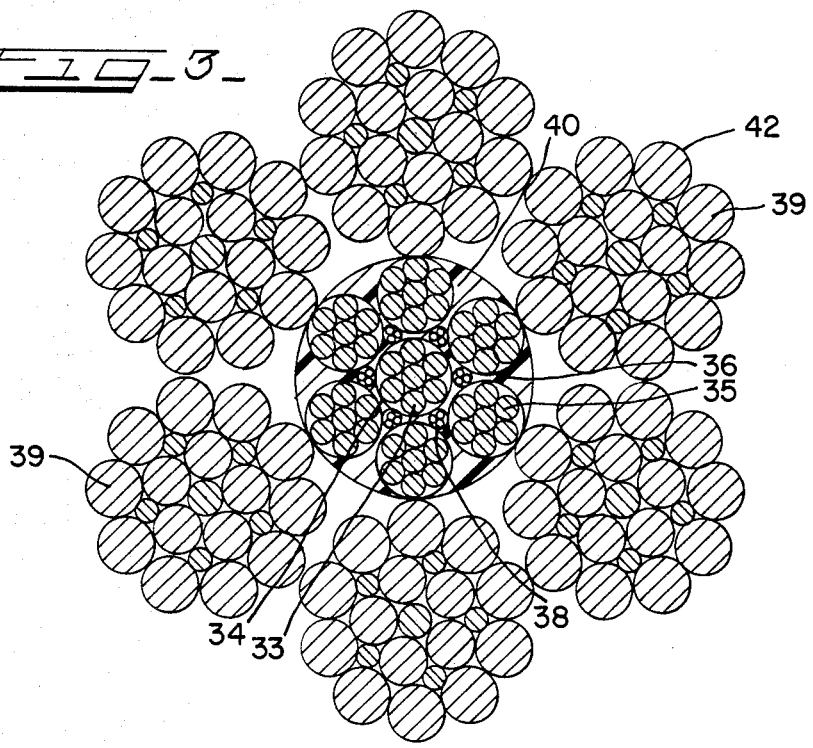
FIG. 3 is a cross sectional view of another encapsulated wire rope made in accordance with the present invention.

Referring now to FIG. 3, a wire rope is shown generally at 32. A central core strand 34 is provided and is comprised of a plurality of individual wires 33. Surrounding core strand 34 are a plurality of intermediate strands 36, each of which is comprised of a plurality of individual wires 35. In the interstices between core strand 34 and intermediate strands 36 are located spacer strands 38. Spacer strands 38 are shown as comprising two wires wound to form a strand. A coating 40 extends from the outer surface of core 34 to the outer diameter limits of intermediate strands 36. Each spacer strand 38 contacts core 34 and two intermediate strands 36. Coating 40 usually comprises a thermoplastic, and separates core strand 34 from intermediate strands 36 and core strands 34 from adjacent core strands and intermediate strands 36 from adjacent intermediate strands. Coating 40 is uniform and, due to its extruded introduction into the rope comprising core strand 34 and intermediate strands 36, forms a continuous, single element composition. A plurality of outer strands 42 each comprising individual wires 39 surround the coated intermediate strands 36.

Figure 4:
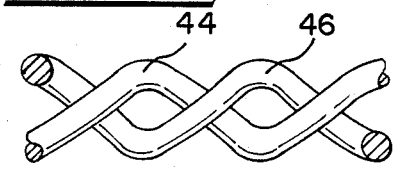
FIG. 4 is a perspective view of one embodiment of a spacer strand.

Referring now to FIGS. 4–7, various embodiments of the spacer strands of the present invention are shown. Normally such spacer strands are of a softer metal than the strands that they separate to avoid notching of the core or outer strands that they separate. In FIG. 4, a spacer strand is shown comprising two individual wires 44 and 46 which are helically wound about each other to form the spacer strand. It is also an embodiment of the present invention to helically wind three wires about each other to form a spacer strand; such an arrangement is shown in cross section in FIGS. 1 and 2.

Figure 5:
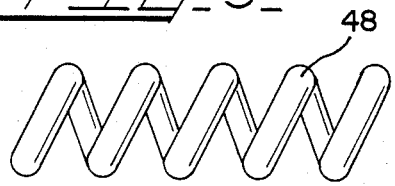
FIG. 5 is a perspective view of another embodiment of a spacer strand.

In FIG. 5, a spacer strand is shown comprising a single wire 48 that is wound into a helix about an imaginary central axis.

Figure 6:
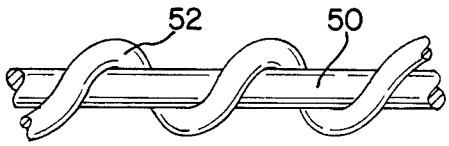
FIG. 6 is a perspective view of another embodiment of a spacer strand.

In FIG. 6, a spacer strand is shown comprising a center wire 50 about which is wound an outer wire 52.

Figure 7:
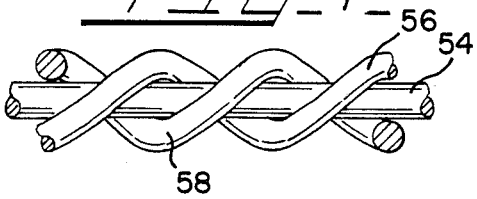
FIG. 7 is a perspective view of another embodiment of a spacer strand.

In FIG. 7, a spacer strand is shown comprising a center wire 54 about which are wound outer wires 56 and 58 in alternating helix arrangement.

What is claimed is:

1. A wire rope comprising:
a central core including a plurality of wire strands,
a plurality of outer strands surrounding said core,
a plurality of spacer strands located in the interstices between said core and said outer strands, said spacer strands leaving passageways to permit flow of a coating material therethrough,
and a coating extending from substantially the outer diameter of the outer strands down to and into the central core.

2. A wire rope comprising:
a central core of wire strands,
a plurality of outer strands surrounding said core,
a plurality of spacer strands located in the interstices between said core and said outer strands each spacer strand contacts the outer surface of the central core and two outer strands,
and a coating extending from substantially the outer diameter of the outer strands down to and into the central core.

3. The wire rope of claim 1, wherein each spacer strand comprises two separate wires helically wound about each other.

4. The wire rope of claim 1, wherein each spacer strand comprises three separate wires helically wound about each other.

5. The wire rope of claim 1, wherein the spacer strand comprises a single wire coiled in a spring like configuration.

6. The wire rope of claim 1, wherein the spacer strand comprises a central wire having a second wire helically wound about it.

7. The wire rope of claim 1, wherein the spacer strand comprises a central wire having two wires wound helically about it.

8. The wire rope of claim 1, wherein the spacer strand is comprised of a softer wire than the core strand and the outer strands.

9. The wire rope of claim 1, wherein the coating is a thermoplastic.

10. The wire rope of claim 1, wherein the coating is an elastomer.

11. The wire rope of claim 1, wherein the coating is of a continuous, single element composition.

12. A wire rope comprising a central core strand, a plurality of intermediate strands surrounding said core strand, and a plurality of outer strands surrounding said intermediate strands, spacer strands located in the interstices between said core strand and said intermediate strands and in the interstices between the intermediate strands and the outer strands, and a coating extending from substantially the outer diameter of said outer strands down to and into said core strand.

13. The wire rope of claim 12, wherein the coating is a thermoplastic.

14. The wire rope of claim 12, wherein the coating is an elastomer.

15. The wire rope of claim 12, wherein the coating is of a continuous, single element composition.

16. The wire rope of claim 12, wherein each of said spacer strands is of a configuration forming passageways so as to permit the flow of the coating therethrough.

17. A method of manufacturing a wire rope comprising the steps of providing a central core strand, winding a plurality of spacer strands about said core strand, winding a plurality of outer strands about said spacer strands and said core strand so as to form evenly dimensioned interstices between said core strand and said outer strands containing said spacer strands, and injecting a coating into said wire rope so as to form a continuous, single element composition between the central core and the outer strands and between the outer strands.

18. The method of claim 17, wherein the coating is a thermoplastic.

19. The method of claim 17, wherein the coating is an elastomer.

20. The method of claim 17, wherein the coating during injection passes through said spacer strands due to their configuration.

* * * * *